United States Patent [19]

Dennis

[11] Patent Number: 4,538,691

[45] Date of Patent: Sep. 3, 1985

[54] ROTARY DRILL BIT

[75] Inventor: Mahlon D. Dennis, Kingwood, Tex.

[73] Assignee: Strata Bit Corporation, Houston, Tex.

[21] Appl. No.: 575,398

[22] Filed: Jan. 30, 1984

[51] Int. Cl.[3] ..... E21B 10/04; E21B 10/60

[52] U.S. Cl. ..... 175/393; 175/404; 175/330

[58] Field of Search ..... 175/393, 404, 403, 330, 175/327, 415, 418, 329, 332, 333, 387

[56] References Cited

U.S. PATENT DOCUMENTS

| | | | |
|---|---|---|---|
| 1,836,638 | 12/1931 | Wright et al. | 175/333 |
| 2,199,692 | 5/1940 | Catland | 175/393 |
| 2,358,052 | 9/1944 | Brown | 175/418 |
| 2,575,826 | 11/1951 | Mecom | 175/415 |
| 2,931,630 | 4/1960 | Grady | 175/329 |
| 3,199,617 | 8/1965 | White | 175/404 |
| 3,548,959 | 12/1970 | Hasiba | 175/393 |
| 3,727,704 | 4/1973 | Abplanalp | 175/329 |
| 4,234,048 | 11/1980 | Rowley | 175/329 |

FOREIGN PATENT DOCUMENTS

| | | | |
|---|---|---|---|
| 237071 | 11/1969 | U.S.S.R. | 175/329 |

*Primary Examiner*—James A. Leppink
*Assistant Examiner*—Hoang C. Dang
*Attorney, Agent, or Firm*—Burns, Doane, Swecker & Mathis

[57] ABSTRACT

A rotary drill bit includes a cutting face having a peripheral edge and a central recess. A plurality of fluid discharge nozzles are mounted in the cutting face. A plurality of cutter elements are mounted in the peripheral edge and in the recess to fracture an earthen core formed as the drill cuts through a formation. A plurality of lateral discharge passages extend radially through the bit body from said recess and extend longitudinally to the peripheral edge to form circumferential interruptions in the peripheral edge. A convex protrusion is disposed centrally at a longitudinally inner end of the recess and includes a convex deflecting surface arranged to contact and fracture the earthen core and deflect the cuttings to the lateral discharge passages. A ridge is disposed along a trailing edge of each of the discharge passages to retard the flow of drilling fluid into the associated discharge passage from an adjacent one of the nozzles, whereby such fluid is caused to flow across cutter elements located behind the ridge.

22 Claims, 6 Drawing Figures

Fig. 4
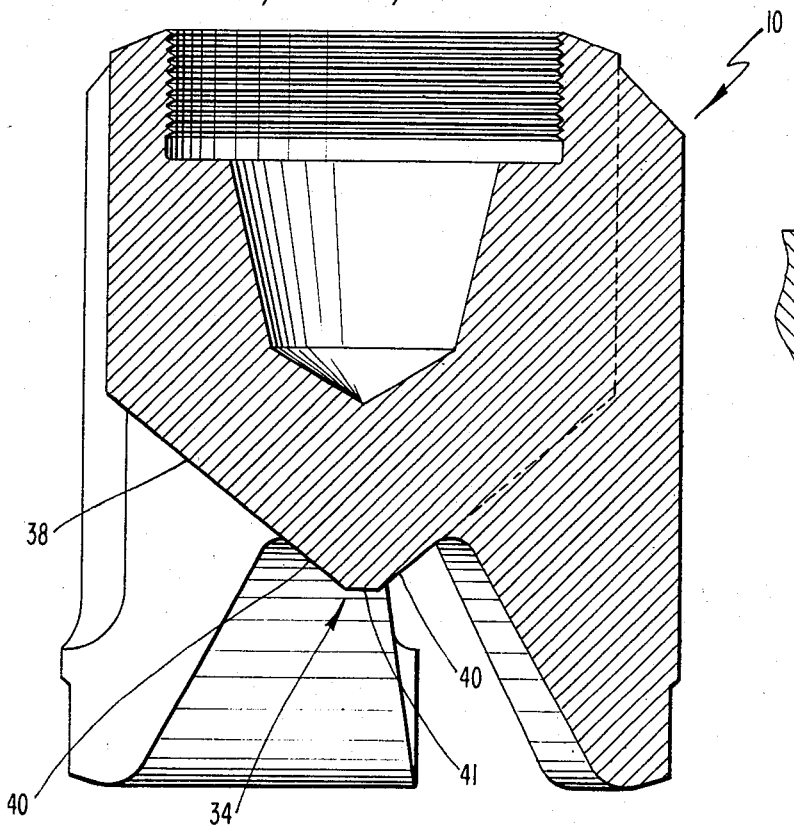
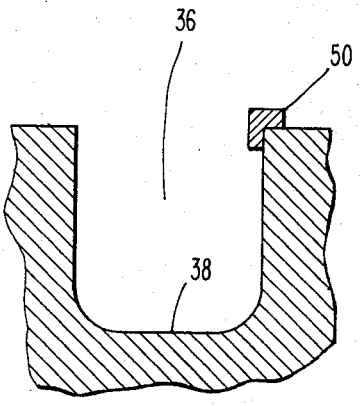
Fig. 6
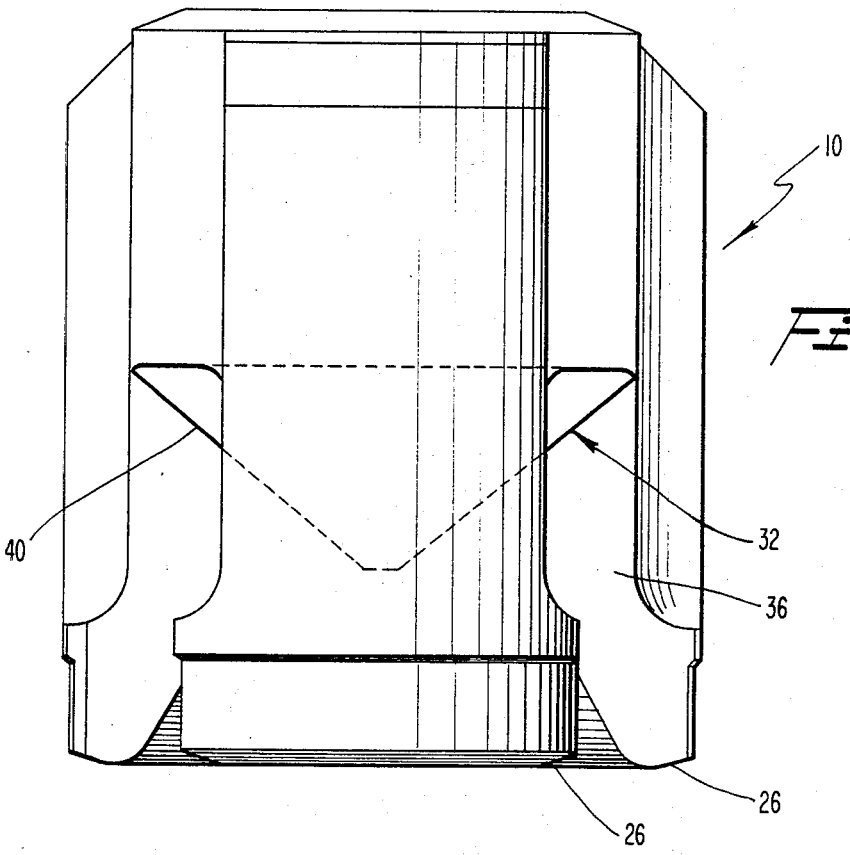
Fig. 5

ROTARY DRILL BIT

BACKGROUND AND OBJECTS OF THE INVENTION

The present invention relates to drill bits for use in rotary drilling through earth formations.

In a typical rotary drilling operation, a rotary drill bit is rotated while being advanced into a soil or rock formation. The soil or rock is cut by cutting elements on the drill bit, and these cuttings are flushed from the borehole by the circulation of drilling fluid toward the top of the borehole. The drilling fluid is delivered to the drill bit downwardly through a passage in the drill stem and is ejected outwardly through nozzles disposed in the cutting face of the drill bit. The ejected drilling fluid is directed outwardly through the nozzles at high speed to aid in cutting, and to flush the cuttings and cool the cutter elements.

A traditional area of concern in the design of rotary drill bits of this type involves the configuration at the center of rotation of the bit cutting face where the linear speed of the cutter elements is relatively slow.

It has been heretofore proposed to provide a drill bit with a concave recess at the center of the cutting face. When cutting through a hard substance, a core of the substance is formed within the recess. The core is gradually broken up by cutter elements disposed within the recess and/or by an inclined surface disposed at an inner end of the recess. The inclined surface also deflects the cuttings laterally through a discharge passage in the bit body. A drill bit of that type has utility in the cutting of both hard and soft substances. In the latter, the lateral discharge passage promotes the discharge of a high volume of cuttings which might otherwise clog-up the recess; thus, cutting may proceed at a faster rate. Exemplary of drill bits of that type are the bits disclosed in Grady U.S. Pat. No. 2,931,630 issued April 5, 1960; Abplanalp U.S. Pat. No. 3,727,704 issued April 17, 1973; and Rowley U.S. Pat. No. 4,234,048 issued Nov. 18, 1980.

Drill bits of the above-described type are subject to certain shortcomings, however, as determined by the present inventor. For example, as the core is engaged and broken up by the inclined surface at the inner end of the recess, an unbalanced force pattern is established on the drill bit. That is, the force generated by the contact between core and the inclined surface includes a radial component which tends to displace the drill bit from its intended travel path. As a result, it becomes difficult to cut in a predetermined straight path.

Furthermore, in cases where the discharge passage in the bit body extends longitudinally all the way to the forward end of the bit, there may be a tendency for drilling fluid to bypass some of the cutting elements mounted on the bit. That is, such a discharge passage forms a convenient travel path for drilling fluid to travel directly from the nozzle to the annulus without contacting the cutter bits to flush and cool same.

It is, therefore, an object of the present invention to minimize or obviate problems of the above-described sort.

Another object is to provide a drill bit which has utility in hard and soft substances and which promotes drilling in a straight direction.

A further object is to provide such a drill bit which minimizes tendencies for drilling fluid to bypass the cutter elements.

An additional object is to provide a centrally recessed drill bit which fractures a core without generating appreciable unbalanced forces on the bit.

A further object is to provide such a drill with a dam that deflects drilling fluid toward cutter elements which otherwise would be bypassed.

SUMMARY OF THE INVENTION

These objects are achieved by the present invention which relates to a rotary drill bit for cutting in earth formations. The drill bit comprises a bit body which includes a cutting face having a peripheral edge and a central recess extending longitudinally inwardly from the peripheral edge. A plurality of fluid discharge nozzles are mounted in the cutting face for emitting drilling fluid under pressure. A plurality of cutter elements are provided. Some of the cutter elements are mounted in the peripheral edge, and others of the cutter elements are mounted in the recess to fracture an earthen core formed as the drill cuts through the formation. A plurality of lateral discharge passages are formed in the bit body. The passages extend radially through the body from the recess and also extend longitudinally to the peripheral edge to form circumferential interruptions in the peripheral edge. A convex protrusion is disposed centrally at a longitudinally inner end of the recess. The protrusion defines a convex deflecting surface which is arranged to contact and fracture the earthen core and deflect the cuttings to the lateral discharge passages.

As a result of such an arrangement, the engagement of the earthen core with the protrusion creates a generally balanced pattern of forces against the drill bit which do not tend to divert the drill bit from its intended path of travel.

Ridges formed of a hard material are disposed along trailing edges of the discharge passages. Each ridge projects from the cutting face by a distance less than that of the cutter elements and is arranged to retard the flow of drilling fluid into the associated discharge passage from an adjacent nozzle whereby such fluid is caused to flow across cutter elements located behind the ridge. In this fashion, the ridge prevents the fluid from bypassing the cutter elements; rather, the fluid contacts the cutter elements to flush and cool same.

THE DRAWINGS

These objects and advantages of the invention will become apparent from the following detailed description of a preferred embodiment thereof in connection with the accompanying drawings in which like numerals designate like elements, and in which:

FIG. 4 is a longitudinal sectional view through the drill bit taken along line 4—4 of FIG. 2, with the nozzles and cutter, elements being omitted for clarity;

FIG. 5 is a side elevational view of the drill bit taken along line 5—5 of FIG. 2, with the nozzles and cutting elements being omitted for clarity; and FIG. 6 is a cross-sectional view taken along the line 6—6 in FIG. 2 to depict a lateral discharge passage and a dam-forming ridge mounted along a trailing edge of the discharge passage.

DETAILED DESCRIPTION OF A PREFERRED EMBODIMENT OF THE INVENTION

Figure 1:
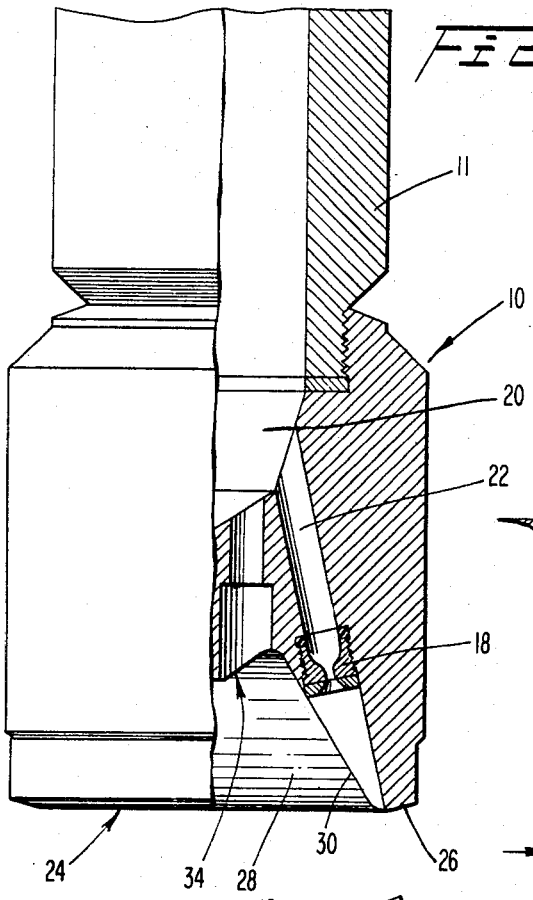
FIG. 1 is a side elevational view, partially in longitudinal section, of a drill bit and drill string according to the present invention.
Figure 3:
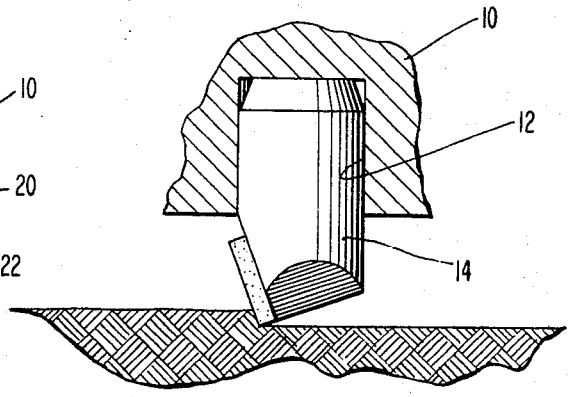
FIG. 3 is a side elevational view of a cutter element employed in the drill bit.
Figure 2:
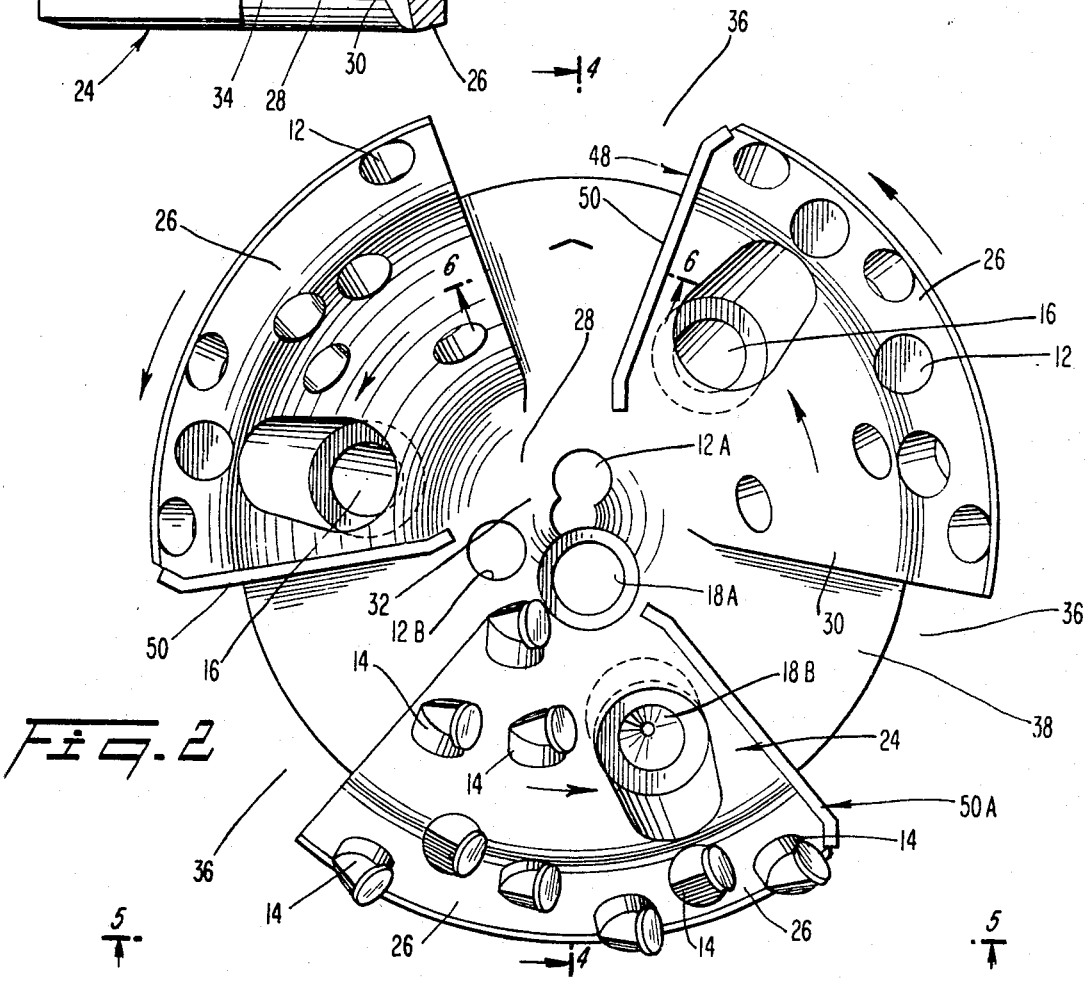
FIG. 2 is an end view of the drill bit, depicting the series of holes for receiving cutter elements and nozzles; some of the holes remainihg empty in FIG. 2 and the remaining holes being depicted as containing nozzles and cutter elements.

Depicted in FIGS. 1 and 2 is a rotary drill bit 10 mounted at the end of a drill stem 11. A plurality of small bores 12 (FIG. 2) are formed in the drill bit body which are adapted to receive cutter elements 14 (FIG. 3). The cutter elements 14 may comprise polycrystalline diamond studs which are conventional or of the type disclosed in U.S. application Ser. No. 553,812 filed Nov. 21, 1983 by the present inventor.

A plurality of larger bores 16 are provided in the drill bit for the reception of nozzles 18 for discharging jets of drilling fluid. The drilling fluid is conducted to the nozzles 18 through a passage 20 in the drill stem 11 and drill bit 10 which communicates with passages 22 in the drill bit. The jet streams aid in the cutting of the formation, cooling of the drill bit cutters, and carrying of the cuttings to the top of the borehole.

The cutting face 24 of the drill bit comprises an outer peripheral edge 26 and a central recess 28. The outer edge 26 slopes longitudinally inwardly (upwardly) and radially outwardly. The recess 28 is defined by side walls 30 which are inclined longitudinally and radially inwardly. The cutting elements 14 are positioned in the peripheral edge 26, in the side walls 30, and in a floor 32 of the recess 28. Most of the nozzles 18 are positioned in the side walls 30, but one of the nozzles 18A is positioned in the floor 32.

The floor 32 of the recess 28 is of concave configuration, the floor preferably comprising a centrally located, generally frusto-conical protuberance 34. If desired, the protuberance 34 could be of other convex shapes such as semispherical for example. Holes 12A, 12B for cutting elements 14 (FIG. 2) are formed in the protuberance 34, and the afore-mentioned nozzle 18A is mounted in the protuberance 34.

The drill bit also includes a plurality of lateral discharge passages 36 which communicate with the central recess 28. Those passages 36 include base surfaces 38 (FIG. 4) which constitute continuations of an inclined wedge face 40 of the protuberance 34. The passages 36, preferably three in number, are equidistantly spaced around the longitudinal axis of the drill bit, i.e., at 120 degree intervals.

Each passage extends radially completely through the bit body and extends longitudinally outwardly to the peripheral edge 26 so as to form gaps in the latter.

It will be appreciated that during a cutting operation, the earth formation is cut so as to form a conical earthen core which projects into the central recess 28. The core is fractured by the combined action of the cutting elements 14 and the convex protuberance 34, the former engaging the sides of the core and the apex 41 of the latter engaging the tip of the core. The convex shape of the surface 40 of the protuberance 34 assures that the reaction forces applied against the protuberance will be distributed around the protuberance and thus will tend to be self-balancing in the radial direction. That is, a concentration of forces at one point on the floor of the recess is avoided. As a result, the drill bit will not be caused to deviate from its intended path of travel by unbalanced forces acting on the floor of the recess.

The cuttings are discharged from the recess through the passages 36 by the action of the surface 40 which serves as a wedge, and by flushing fluid from the nozzles 18, 18A.

Disposed on the cutting face of the drill bit along the trailing edge 48 of each lateral discharge passage 36 is a ridge 50 (FIG. 6). The ridge 50 can be formed of a hard or a soft substance, as desired. For example, the ridge 50 can be formed of a hard material such as tungsten carbide or 4140 steel, or formed of a softer substance such as a soft steel (e.g., 1020 steel). The ridge 50 projects outwardly from the cutting face by a distance slightly less than that of the cutter elements 14 and extends longitudinally along the side wall of the recess and radially along the peripheral edge 26.

The ridge 50 performs two important functions. Firstly, the ridge acts to dam-up drilling fluid ejected from the adjacent trailing nozzle 18B (i.e., the nearest nozzle 18B spaced clockwise from the ridge 50 in FIG. 2). That is, in the absence of the ridge, much of the drilling fluid emanating from that nozzle would flow into the adjacent gap in the peripheral edge (i.e., the gap formed by the discharge passage) and then upwardly through the annulus. However, upon encountering the ridge 50, the fluid travel is blocked, causing the fluid to rebound and flow to the adjacent cutting elements located behind the ridge, i.e., the cutting elements spaced clockwise from the ridge 50 in FIG. 2.

As noted earlier, the ridges 50 project from the cutting face 24 by a distance less than, e.g., one-half, that of the cutter elements 14. The difference in such projecting distance is about equal to the expected penetration depth of the cutter elements. In this fashion, the ridge will essentially contact the formation, thereby minimizing the travel of fluid between the ridge and the formation.

A second important function of the ridge 50 is to act as a plow to push larger cuttings from the associated discharge passage so that such cuttings do not contact and damage the cutting elements located behind the ridge. In softer substances the ridges 50 may serve as cutter blades as well as plows.

IN OPERATION, the drill bit is rotated while simultaneously advanced into an earth formation. As the cutting operation progresses an earthen core is formed which is disposed within the recess 28. The sides of the core are gradually fractured by the cutter elements 14 disposed within the recess, and the tip of the earthen core is fractured by the cutter elements disposed in the floor of the recess, as well as by the convex protuberance 34. Engagement between the core and the protuberance is such as to establish generally radially balanced forces on the drill bit whereby the drill bit is not diverted from its intended path of travel.

The convex protuberance 34 deflects the cuttings laterally outwardly through the discharge passages 36. Ejection of larger chunks through the discharge passages is aided by the ridges 50 which act as plows to push the chunks along.

The ridges 50 also serve to block the escape of drilling fluid from the nozzles 18. Instead, that fluid rebounds rearwardly and flows across the cutter elements disposed behind the respective ridges in order to flush and cool those cutter elements.

It will be appreciated that the present invention minimizes the likelihood that unbalanced radial forces will be exerted against the drill bit in response to contact between the earthen core and the floor of the recess. Consequently, it is easier to maintain the drill bit in a straight path of travel.

The presence of the ridges 50 aids in pushing larger chunks through the lateral discharge openings and thereby minimizes the likelihood that such chunks could contact and damage the cutter elements.

It is also assured that the cutter elements will be supplied with a substantial amount of cooling and flushing fluid, since it will be difficult for such fluid to bypass the cutter elements by flowing directly into the lateral discharge openings and upwardly through the annulus, due to the presence of the ridges.

Although the present invention has been described in connection with a preferred embodiment thereof, it will be appreciated by those skilled in the art that modifications, additions, deletions, and substitutions may be made without departing from the spirit and scope of the invention as defined in the appended claims.

What is claimed is:

1. A rotary drill bit for cutting in earth formations, comprising:

a bit body rotatable about its longitudinal axis and including a cutting face having a peripheral edge and a central recess extending longitudinally rearwardly from said peripheral edge, said recess including side walls facing said longitudinal axis, a plurality of cutter elements, some of which being mounted in recesses in said peripheral edge, and others of which being mounted in recesses in said side walls to fracture an earthen core formed as the drill cuts through the formation, a plurality of generally forwardly directed fluid discharge nozzles mounted in said side walls for emitting pressurized drilling fluid such that said drilling fluid travels along said side walls and said peripheral edge and across said cutter elements to flush and cool said cutter elements, a plurality of lateral discharge passages formed in said body, said passages extending radially through said body from said central recess and extending longitudinally to said peripheral edge to form circumferential interruptions in said peripheral edge, and a convex protrusion disposed centrally at a longitudinally rearward end of said recess and including a convex deflecting surface, said protrusion arranged to contact and fracture the earthen core and deflect the cuttings to said lateral discharge passages.

2. A drill bit according to claim 1 including a ridge disposed along a trailing edge of each of said discharge passages, each ridge projecting from said cutting face by a distance less than that of said cutter elements and being arranged to retard the flow of drilling fluid into the associated discharge passage from an adjacent one of said nozzles, whereby such fluid is caused to flow across cutter elements located behind said ridge.

3. A drill bit according to claim 2, wherein said ridges are formed of a hard material.

4. A drill bit according to claim 2, wherein said ridges are formed of a soft material.

5. A drill bit according to claim 2, wherein said cutter elements project farther from said cutting face than said ridges by a distance equal to the expected penetration depth of said cutter elements.

6. A drill bit according to claim 2, wherein said ridges project from said cutting face by a distance equal to about one-half the distance which said cutter elements project from said cutting face.

7. A drill bit according to claim 1, wherein said protrusion is of frusto-conical shape.

8. A drill bit according to claim 1, wherein some of said nozzles are mounted in a side wall of said recess and one of said nozzles is mounted in said protrusion.

9. A drill bit according to claim 1, wherein at least one of said cutter elements is mounted in a recess in said protrusion.

10. A drill bit according to claim 1, wherein there are three of said discharge passages, said passages disposed equidistantly around the circumference of said bit.

11. A drill bit according to claim 1, wherein each said discharge passage includes longitudinally spaced forward and rearward ends, said convex deflecting surface being disposed closer to said rearward ends than to said forward ends.

12. A drill bit according to claim 11, wherein said side walls are inclined with respect to said longitudinal axis so as to approach said axis in a rearward direction.

13. A drill bit according to claim 12, wherein at least one of said cutter elements in said side walls is situated at least as far rearwardly in said recess as said nozzles.

14. A drill bit according to claim 1, wherein said side walls are inclined with respect to said longitudinal axis so as to approach said axis in a rearward direction.

15. A rotary drill bit for cutting in earth formations, comprising:

a bit body including a cutting face having a central recess extending longitudinally inwardly, a plurality of fluid discharge nozzles mounted in said recess for emitting drilling fluid under pressure, a plurality of cutter elements mounted in said recess to fracture an earthen core formed as the drill cuts through the formation, a plurality of lateral discharge passages formed in said body, said passages extending completely radially through said body from said recess, and extending longitudinally to a forward end of said bit body, a convex protrusion disposed centrally at a longitudinally inner end of said recess for fracturing the earthen core and displacing the cuttings to said discharge passages, and a plurality of ridges disposed along trailing edges of said passages, said ridges extending along said recess and projecting outwardly from said cutting face to retard the flow of fluid into the associated passage from said nozzles, whereby such fluid rebounds and flows across cutter elements mounted behind respective ridges.

16. A drill bit according to claim 15, wherein said ridges project from said cutting face by a distance less than that of said cutter elements.

17. A drill bit according to claim 15, wherein said ridges project from said cutting face by a distance less than the distance which said cutter elements project, the difference between said distances being substantially equal to the expected penetration depth of said cutter elements.

18. A drill bit according to claim 17, wherein said difference is about one-half of the projecting distance of said cutter elements.

19. A drill bit according to claim 15, wherein said ridges are formed of a hard substance.

20. A drill bit according to claim 15, wherein said ridges are formed of a soft material.

21. A rotary dill bit for cutting earth formations, comprising:

a bit body rotatable about its longitudinal axis and including a cutting face having a peripheral edge and a central recess extending longitudinally rearwardly from said peripheral edge, said recess including side walls facing said longitudinal axis, said side walls being inclined with respect to said axis so as to approach said axis in a rearward direction, said peripheral edge and said side walls having recesses therein, a plurality of cutter inserts, some of which being mounted in said recesses in said peripheral edge, and others of which being mounted in said recesses in said side walls to fracture an earthen core formed as the drill cuts through the formation, a plurality of generally forwardly directed fluid discharge nozzles mounted in said cutting face for emitting pressurized drilling fluid into said central recess, said nozzles being oriented to direct drilling fluid along said side walls and said peripheral edge and across said cutter elements to flush and cool said cutter elements, at least one of said cutter inserts in said side walls being situated at least as far rearwardly in said recess as said nozzles, a plurality of lateral discharge passages formed in said body, said passages extending radially through said body from said central recess and extending longitudinally to said peripheral edge to form circumferential interruptions in said peripheral edge, said passages each including longitudinally spaced rearward and forward ends, and a convex protrusion disposed centrally at a longitudinally rearward end of said central recess and including a convex deflecting surface, said protrusion arranged to contact and fracture the earthen core and deflect the cuttings to said lateral discharge passages, said deflecting surface being disposed closer to said rearward ends of said passages than to said forward ends thereof.

22. A rotary dill bit for cutting in earth formations, comprising:

a bit body including a cutting face having a peripheral edge and a central recess extending longitudinally inwardley from said peripheral edge, a plurality of fluid discharge nozzles mounted in said cutting face for emitting drilling fluid under pressure, a plurality of cutter elements, some of which being mounted in said peripheral edge, and others of which being mounted in said recess to fracture an earthen core formed as the drill cuts through the formation, a plurality of lateral discharge passages formed in said body, said passages extending radially through said body from said recess and extending longitudinally to said peripheral edge to form circumferential interruptions in said peripheral edge, a convex protrusion disposed centrally at a longitudinally inner end of said recess and including a convex deflecting surface, said protrusion arranged to contact and fracture the earthen core and deflect the cuttings to said lateral discharge passages, and a ridge disposed along a trailing edge of each of said discharge passages, each ridge projecting from said cutting face by a distance less than that of said cutter elements and being arranged to retard the flow of drilling fluid into the associated discharge passage from an adjacent one of said nozzles, whereby such fluid is caused to flow across cutter elements located behind said ridge.

* * * * *